US007489227B2

(12) United States Patent
Fabian et al.

(10) Patent No.: US 7,489,227 B2
(45) Date of Patent: Feb. 10, 2009

(54) ELECTRICAL RECEPTACLE WITH MULTIPLE HEAT SENSORS

(75) Inventors: Steven D. Fabian, Port Jefferson, NY (US); Michael Nordmeyer, Pittstown, NJ (US); Douglas Watchorn, Frenchtown, NJ (US)

(73) Assignee: BSafe Electrix, Inc., Manhasset, NY (US)

( * ) Notice: Subject to any disclaimer, the term of this patent is extended or adjusted under 35 U.S.C. 154(b) by 325 days.

(21) Appl. No.: 11/429,169

(22) Filed: May 4, 2006

(65) Prior Publication Data

US 2007/0257763 A1 Nov. 8, 2007

(51) Int. Cl.
*H01H 73/30* (2006.01)
*H01H 73/08* (2006.01)

(52) U.S. Cl. ..... 337/37; 337/36; 337/75; 337/70; 337/72; 337/78; 337/113

(58) Field of Classification Search ..... 337/36, 337/37, 75, 70, 72, 78, 113
See application file for complete search history.

(56) References Cited

U.S. PATENT DOCUMENTS

| | | | | |
|---|---|---|---|---|
| 1,955,076 | A * | 4/1934 | Ludwig | 337/92 |
| 2,563,066 | A * | 8/1951 | Procopio | 307/149 |
| 2,597,600 | A * | 5/1952 | Shapiro | 439/651 |
| 2,636,096 | A * | 4/1953 | Di Blasi | 337/189 |
| 2,783,329 | A * | 2/1957 | Jackson | 337/91 |
| 3,539,961 | A * | 11/1970 | Worthington | 337/197 |
| 3,699,285 | A * | 10/1972 | Leatherman | 200/51.09 |
| 3,846,598 | A * | 11/1974 | Mucsi | 200/51.09 |
| 4,059,843 | A * | 11/1977 | Girismen | 361/102 |
| 4,148,536 | A * | 4/1979 | Petropoulsos et al. | 439/188 |
| 4,271,337 | A * | 6/1981 | Barkas | 200/51.09 |
| 4,514,715 | A * | 4/1985 | Chen | 337/113 |
| 4,538,134 | A * | 8/1985 | Carey | 337/113 |
| 4,853,823 | A * | 8/1989 | Arechavaleta et al. | 361/100 |
| 4,871,924 | A * | 10/1989 | Sellati | 307/86 |
| 4,951,025 | A * | 8/1990 | Finnegan et al. | 337/113 |
| 4,995,017 | A * | 2/1991 | Sellati et al. | 307/86 |
| 5,262,749 | A * | 11/1993 | Kopelman | 337/103 |
| 5,590,010 | A * | 12/1996 | Ceola et al. | 361/93.4 |
| 6,166,618 | A * | 12/2000 | Robertson et al. | 337/380 |
| 6,204,747 | B1 * | 3/2001 | Kitchens | 337/407 |
| 6,340,926 | B1 * | 1/2002 | Chu | 337/407 |
| 6,753,755 | B2 * | 6/2004 | Montague | 337/265 |
| 2004/0246638 | A1 * | 12/2004 | Davies | 361/42 |
| 2005/0212646 | A1 * | 9/2005 | Watchorn et al. | 337/16 |

* cited by examiner

*Primary Examiner*—Anatoly Vortman
(74) *Attorney, Agent, or Firm*—Brenda Pomerance

(57) ABSTRACT

An electrical receptacle has multiple thermal sensors, each of which can trigger automatic shut off when the temperature rises above a predetermined threshold. After automatically turning off, the receptacle remains permanently non-conducting.

8 Claims, 6 Drawing Sheets

ELECTRICAL RECEPTACLE WITH MULTIPLE HEAT SENSORS

BACKGROUND OF THE INVENTION

The present invention relates to an electrical plug receptacle having multiple sensors for sensing the temperature at multiple points within an enclosure of the receptacle, and that automatically shuts off when any of these temperatures reach a pre-determined temperature.

Many fires are believed to be caused by overloaded electrical outlets, that is, outlets operated with more power transfer than the outlet was designed for. Fires are sometimes caused by a loose connection, a glowing connection and/or a high resistance path. A glowing connection occurs when copper oxide is formed between a copper wire and a screw in a small air gap creating carbon which glows.

The condition of too much power usage is always accompanied by increased temperature in at least one of the ambient temperature, the receptacle temperature and the temperature of a prong of an electrical plug inserted into the receptacle, collectively referred to herein as "operating temperature". To avoid fires, it is desirable for the outlet to sense when the operating temperature is too hot, and to cease operation.

Bimetallic switches are electromechanical thermal sensors. The bimetallic or bi-metal portion consists of two different metals bonded together such as brass and Invar. Some bimetallic portions consist of three layers sandwiched together. The metals expand at different rates as they warm, causing the element to twist or curve. The changing geometry is used to make or break an electrical contact. Once temperature has returned to normal levels, they revert back to their original geometry.

For a bimetal comprising brass and invar, the bending occurs at a metal temperature of about 200° F.; the actual temperature threshold is determined by the design of the bimetal and its materials. The metal can be heated by a loose connection or by ambient air temperature. Typical plastic household wiring insulation and outlet housing melts at a temperature of about 300° F. but operation above 200° F. is not recommended due to its high probability of material distortion.

It has been proposed to use a bimetal to sense the temperature of an electrical receptacle, and to interrupt operation of the receptacle when the temperature increases beyond a threshold. In practice, proposed designs do not trigger properly because of the time it takes for heat to propagate from the fault area to the bimetal.

Accordingly, there is a need for an electrical receptacle with improved thermal sensitivity.

SUMMARY OF THE INVENTION

In accordance with an aspect of this invention, there is provided an electrical receptacle for supplying power to an electrical plug, comprising at least one outlet for receiving load and neutral prongs of the electrical plug, the outlet having a plug prong contact pair for each of the load and neutral prongs, at least three thermal sensors for sensing temperature at respective locations in the electrical receptacle and for detecting temperature greater than a predetermined threshold, and a power cutoff mechanism for interrupting power to the electrical plug when at least one of the thermal sensors detects temperature greater than the predetermined threshold.

Each thermal sensor includes a bimetallic element that changes its shape at a predetermined temperature. Thermal sensors sense the temperature of terminals and plug prong contact pairs in contact with hot, load and neutral conductors. The plug prong contact pairs are associated with prongs of the electrical plug.

DETAILED DESCRIPTION

Temperature overloads typically occur due to a problem at the terminals of an electrical receptacle, where wires are attached to the receptacle. When the attaching wires are improperly connected, such as being too loose, there is unexpected electrical resistance. In some cases, the metal of the attaching wires is different than the metal of the electrical receptacle, causing a resistance mismatch.

When a receptacle includes only one thermal sensor, if the thermal problem is close to the sensor, the thermal overload circuitry will be properly triggered. However, if the thermal problem is not close to the sensor, then the thermal overload circuitry has a high risk of not triggering properly due to heat conduction issues. For example, brass, commonly used in receptacles, is a poor heat conductor, while copper, silver and gold are good heat conductors.

If a receptacle having only one thermal sensor is fitted with heat conducting bridges between respective terminals and the thermal sensor, desired triggering is still not achieved due to differences in resistance and symmetry among the bridges.

Figure 1:
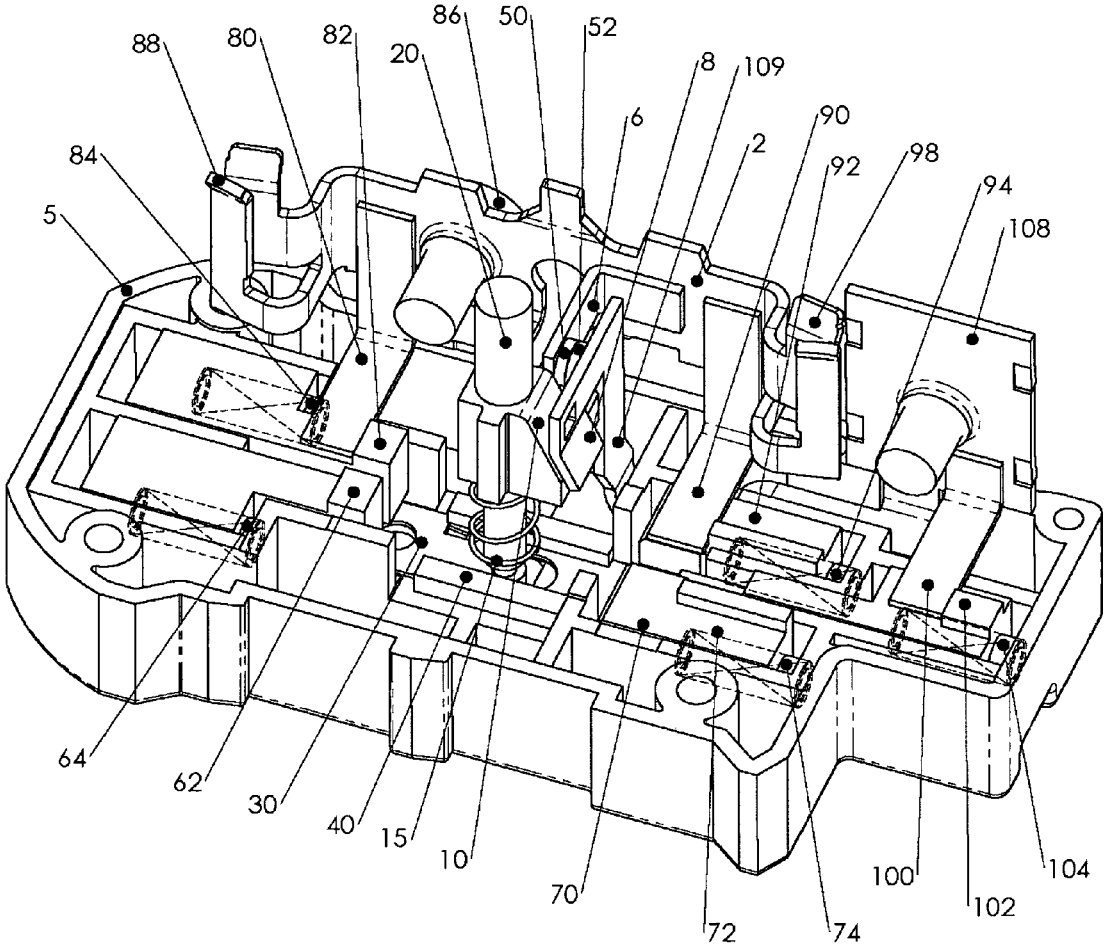
FIG. 1 is a three-dimensional cut-away view of an electrical receptacle with multiple thermal sensors.
Figure 2:
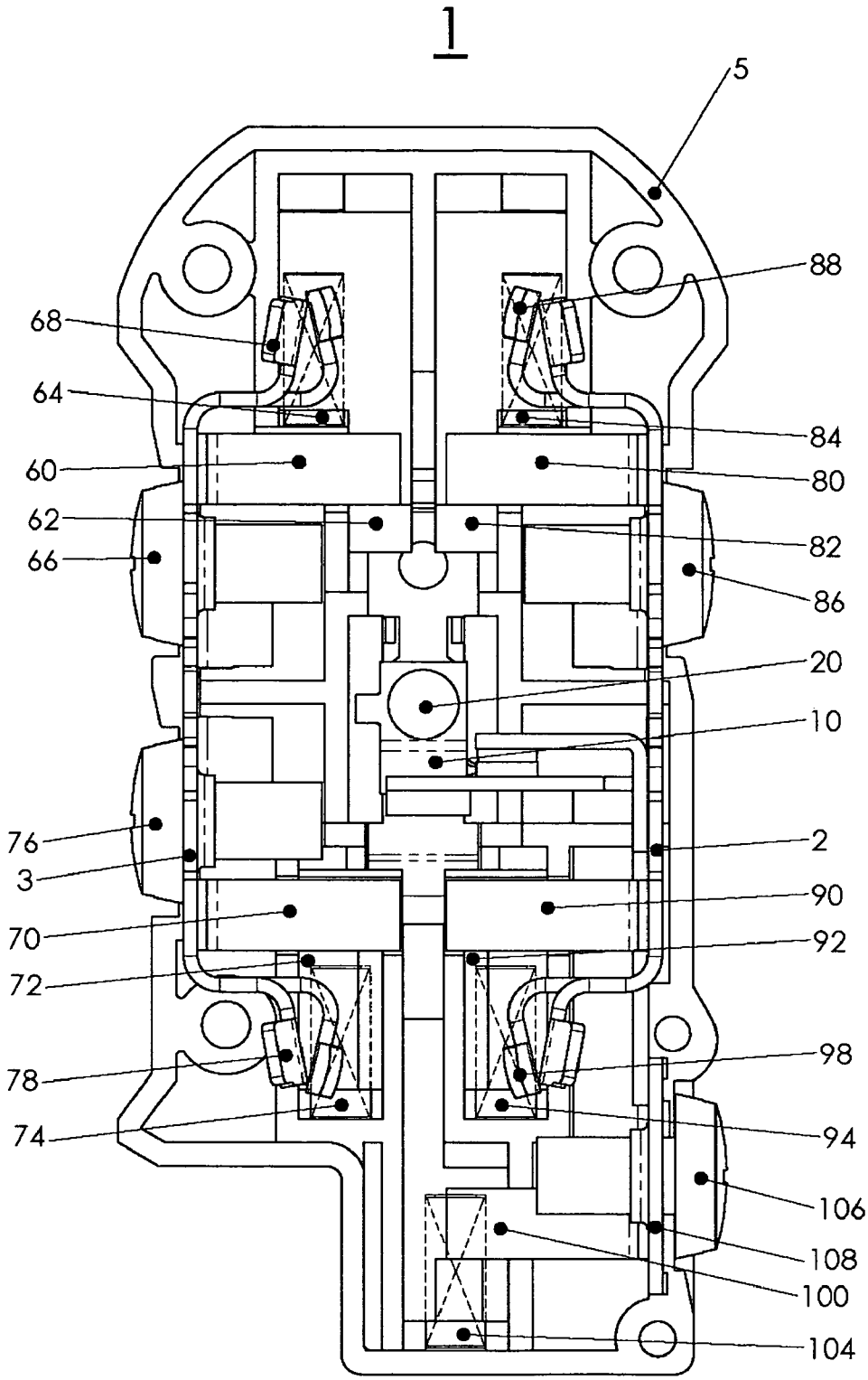
FIG. 2 is a top-down view of the receptacle of FIG. 1 without the grounding yoke.

FIGS. 1 and 2 show an electrical receptacle with multiple thermal sensors and a shut-off mechanism. FIG. 1 is a cut-away view not showing several parts for clarity in showing the remaining parts. The sensors are located at each of the four terminals (also referred to as screws) for the receptacle: neutral terminals 66, 76; load terminal 86; and hot terminal 106, and also at load conductor 2 in the receptacle. When any one of the thermal sensors triggers, the shut-off mechanism for the receptacle is activated.

Figure 3:
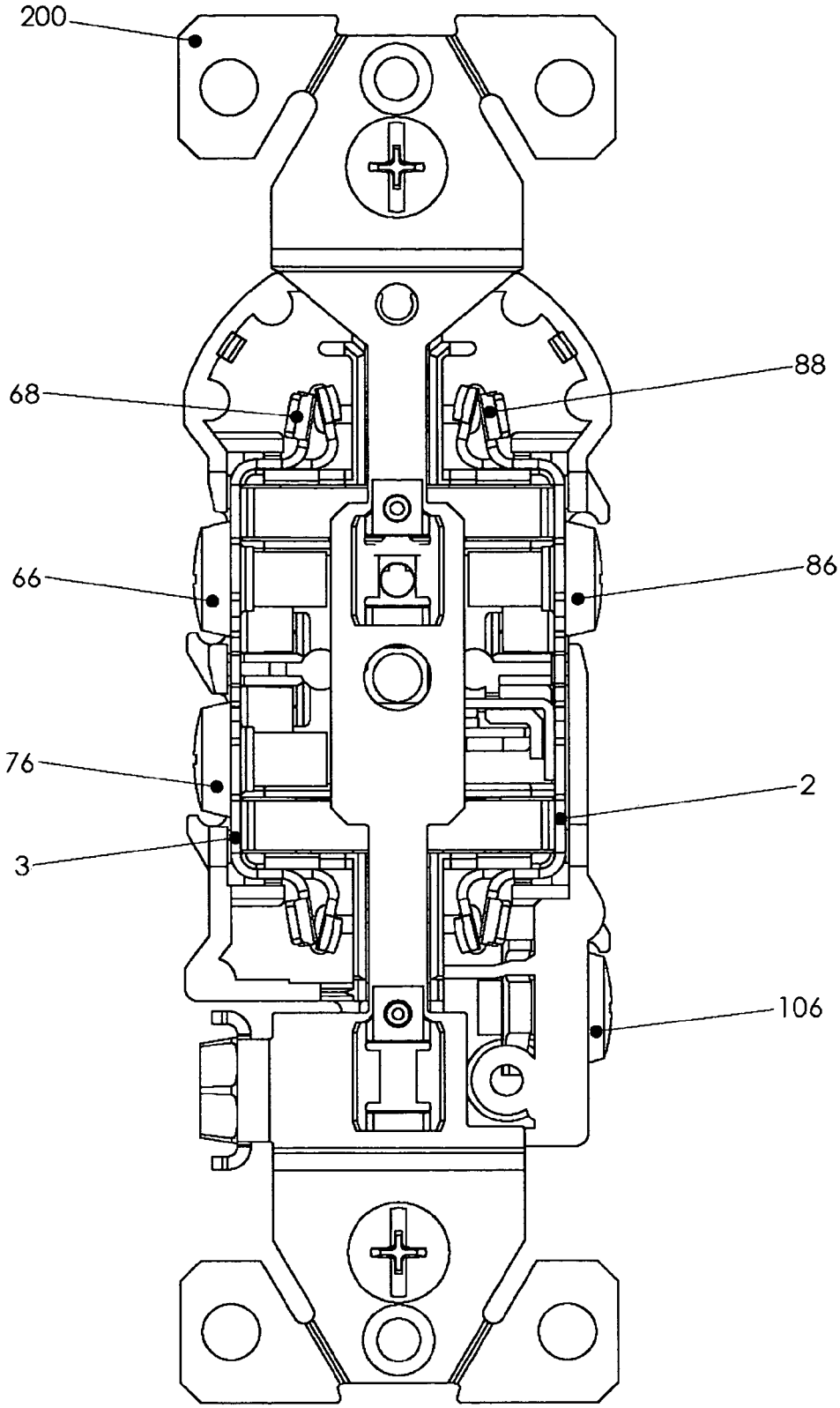
FIG. 3 is a top-down view of the receptacle of FIG. 1, with the grounding yoke in place.

FIG. 3 shows grounding yoke 200 placed over the assembly shown in FIG. 2. Grounding yoke 200 serves to connect receptacle 1 to an outlet box (not shown) in a wall.

Each thermal sensor comprises an L-shaped bimetal, a spring located at the base of the bimetal, the axis of the spring being perpendicular to the plane of the bimetal, and a housing for the spring. During operation, the spring is held in place by the horizontal base of the bimetal. When the temperature of the bimetal exceeds a threshold, the base flips to another configuration, releasing the spring.

A shut-off mechanism comprises a shot pin, a vertical spring, two contacts and a latch. The latch is coupled to the thermal sensors so that when one of the thermal sensors triggers, the latch moves to release the vertical spring, and the vertical spring causes the shot pin to pop upwards, separating the contacts and interrupting operation of the receptacle.

Electrical receptacle 1 has load conductor 2; neutral conductor 3; hot conductor 109 having ramp 8; enclosure 5;

contact plate 6; shot pin 20 with circular groove 16, base 17, lip 18 and trip part 10 having arm 22; horizontal spring 14; vertical spring 15; latch 30 with L-shaped end 32, U-shaped end 34, and oval opening 36; support base 40 with groove 45; first contact 50; second contact 52; bimetals 60, 70, 80, 90, 100; housings 62, 72, 82, 92, 102; horizontal springs 64, 74, 84, 94, 104; screws (also referred to as terminals) 66, 76, 86, 106; and plug prong contact pairs 68, 78, 88, 98; and hot terminal plate 108.

Electrical receptacle 1 accommodates two plugs. A top plug (not shown) has two prongs that insert into plug prong contact pairs 68 and 88. A bottom plug (not shown) has two prongs that insert into plug prong contact pairs 78, 98. During normal operation, current flows from hot terminal 106 to screw plate 108 then to hot conductor 109 through contacts 50, 52, then via load conductor 2 to load terminal 86, and/or plug prong contact pairs 88, 98, then to the connected device (not shown) plugged into the receptacle, and back to neutral plug prong contact pairs 68, 78 and/or neutral terminals 66, 76, in a generally similar manner as a standard ground fault circuit interrupt (GFCI) receptacle (not shown).

Electrical receptacle 1 has five thermal sensors.

A first thermal sensor comprises bimetal 60, housing 62 and spring 64, and is responsive to temperature changes at screw 66 and plug prong contact pair 68 that are in contact with neutral conductor 3.

A second thermal sensor comprises bimetal 70, housing 72 and spring 74, and is responsive to temperature changes at screw 76 and plug prong contact pair 78 that are in contact with neutral conductor 3.

A third thermal sensor comprises bimetal 80, housing 82 and spring 84, and is responsive to temperature changes at screw 86 and plug prong contact pair 88 that are in contact with load conductor 2.

A fourth thermal sensor comprises bimetal 90, housing 92 and spring 94, and is responsive to temperature changes at load plug prong contact pair 98 that is in contact with load conductor 2.

A fifth thermal sensor comprises bimetal 100, housing 102 and spring 104, and is responsive to temperature changes at screw 106 that is in contact with hot terminal plate 108 that is in contact with hot conductor 109.

Electrical receptacle 1 has a shut-off mechanism, also referred to as a shot pin trigger assembly, comprising shot pin 20, trip part 10, vertical spring 15, contacts 50, 52 and latch 30.

Figure 5:
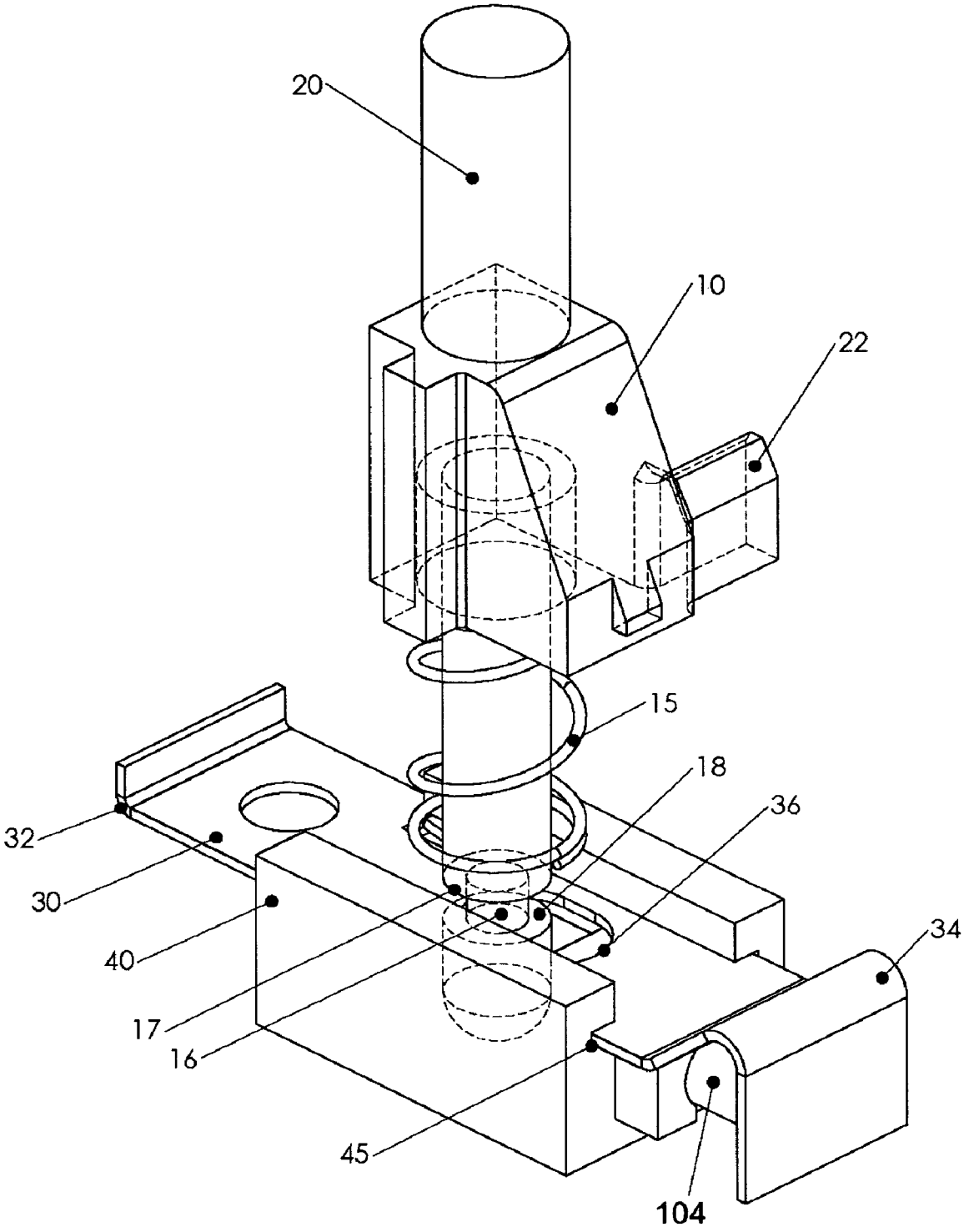
FIG. 5 is a three-dimensional cut-away view of the shot pin assembly in the receptacle of FIG. 1.

FIG. 5 is a three-dimensional view of a shot pin trigger assembly. As shown, support base 40 has horizontal groove 45. The edge of latch 30 inserts into groove 45, and is retained thereby so that latch 30 moves only in a horizontal direction. Latch 30 has oval shaped opening 36 approximately in its center. End 34 of latch 30 has a U-shape to enclose horizontal spring 14. End 32 of latch 30 has an L-shape Shot pin 20 is positioned vertically in oval opening 36 of latch 30. At approximately its midsection, shot pin 20 is enclosed by trip part 10 having arm 22. Vertical spring 15 is coiled around shot pin 20 underneath trip part 10. Base 17 of shot pin 20 has circular groove 16. In the un-triggered position, bottom lip 18 of circular groove 16 engages with the bottom edge of oval opening 36, and horizontal spring 14 exerts force on the inside of U-shaped end 34 of latch 30 to pull oval opening 36 so as to engage circular groove 16 in base 17 of shot pin 20, thereby restraining shot pin 20, i.e., keeping shot pin 20 in an un-triggered state.

When the temperature of bimetal 100 in the thermal sensor associated with hot terminal plate 108 exceeds a predetermined temperature threshold, the horizontal part of L-shaped bimetal 100 moves upward allowing spring 104 to push housing 102 into latch 30, opposite to and overcoming the force of horizontal spring 14, thereby removing the restraining edge of oval opening 36 from circular groove 16 in base 17 of shot pin 20, and enabling vertical spring 15 to pop shot pin 20 upwards, moving ramp 8 on hot conductor 109 to disconnect contacts 50, 52, which disconnects load plug prong contact pairs 88, 98 and/or load terminal 86. After shot pin 20 triggers, its top is visible, serving as an indication that the temperature of the receptacle has become too hot for operation. After turning off, the receptacle remains permanently non-conducting.

Figure 6:
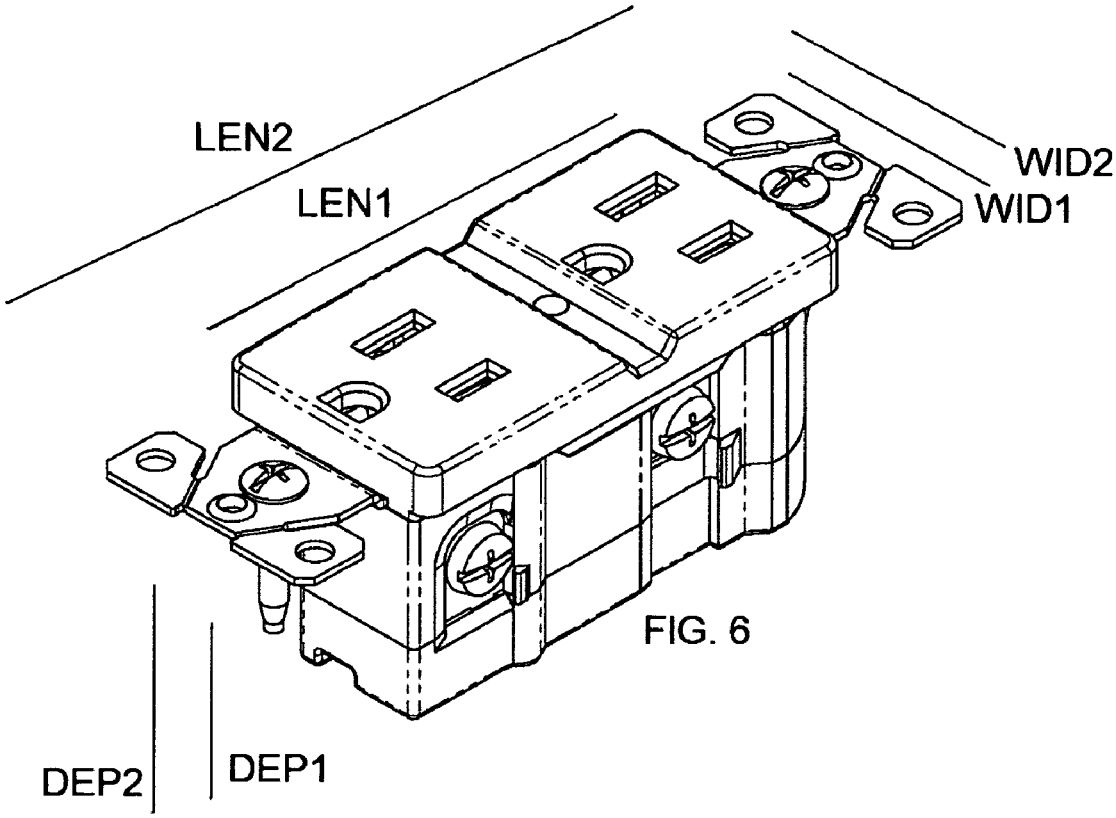
FIGS. 6 and 7 are three-dimensional views of the exterior of the receptacle of FIG. 1 in its normal and triggered operational states.
Figure 7:
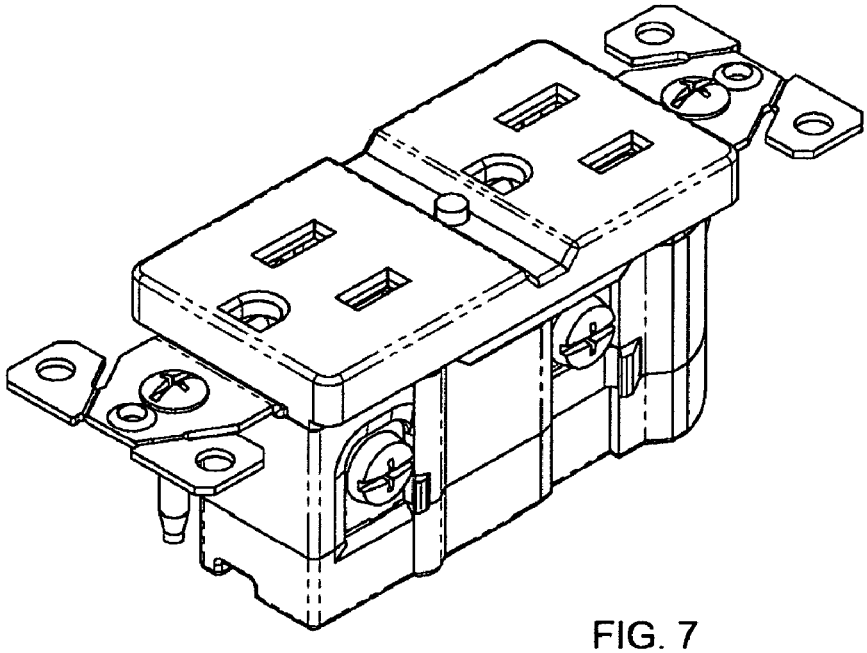

FIGS. 6 and 7 are three-dimensional views of the exterior of receptacle 1 in its normal and triggered operational states. In FIG. 6, the top of shot pin 20 is seen to be flush with the exterior of the receptacle while in its normal, unreleased state. In FIG. 7, the top of shot pin 20 is seen to protrude from the exterior of the receptacle when in its released state, serving as an indicator to the user that the receptacle's thermal protection has activated.

Figure 4:
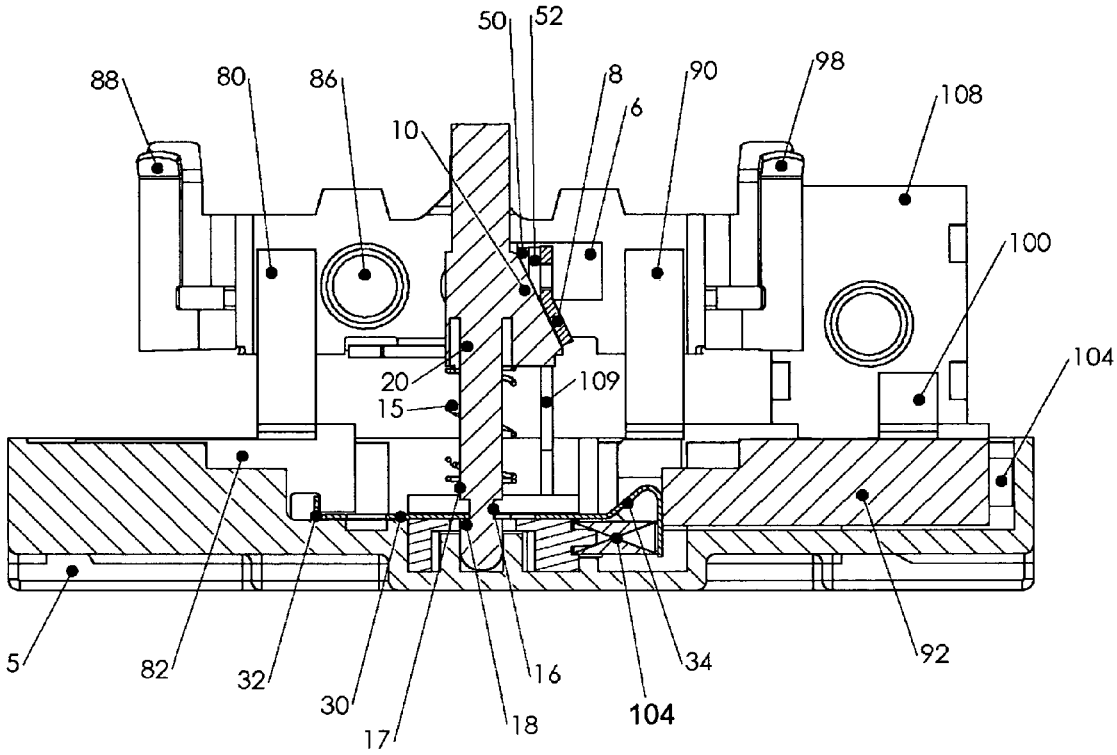
FIG. 4 is a cross-sectional view of the receptacle of FIG. 1.

The other four bimetals serve to allow shot pin 20 to pop in similar manner, except housings 62, 82 serve to pull latch 30 whereas housings 72, 92, 102 serve to push latch 30, as best seen in FIG. 4. Specifically, housings 62, 82, located at the left side of latch 30, engage with L-shaped end 32 of latch 30, while housing 72, 92, 102, located at the right side of latch 30, engage with U-shaped end 34 of latch 30.

Table 1 compares the exterior dimensions, in inches, of receptacle 1, a standard dual outlet receptacle and a ground fault circuit interrupt (GFCI) dual outlet receptacle. With reference to FIG. 6, LEN1 is the length of the faceplate of the receptacle, LEN2 is the length of the entire receptacle, WID1 is the width of the end attachment piece, WID2 is the width of the faceplate of the receptacle, DEP1 is the depth from the attachment piece to the bottom of the receptacle, and DEP2 is the depth from the faceplate to the bottom of the receptacle.

TABLE 1

| | receptacle 1 | standard | GFCI |
|---|---|---|---|
| LEN1 | 2.630 | 2.630 | 2.639 |
| LEN2 | 4.194 | 4.194 | 4.193 |
| WID1 | 1.300 | 1.300 | 1.300 |
| WID2 | 1.300 | 1.300 | 1.734 |
| DEP1 | 1.165 | 0.690 | 1.550 (1.200 without base extension) |
| DEP2 | 1.413 | 0.938 | 1.900 (1.530 without base extension) |

In the above-described embodiment, the bimetals are shown as being L-shaped. However, any other shape such as straight or domed is also usable. In these cases, other elements of the receptacle are adjusted accordingly.

An embodiment with four thermal sensors is similar to the above-discussed embodiment with five thermal sensors, except that bimetal 90 is absent, leaving bimetals 60, 70, 80, 100 corresponding to screws 66, 76, 86, 106. Thermal detection efficiency generally improves with the number of bimetals used.

The present temperature sensing features could be added to a GFCI receptacle.

Although illustrative embodiments of the present invention, and various modifications thereof, have been described in detail herein with reference to the accompanying drawings, it is to be understood that the invention is not limited to these precise embodiments and the described modifications, and that various changes and further modifications may be effected therein by one skilled in the art without departing from the scope or spirit of the invention as defined in the appended claims.

What is claimed is:

1. An electrical receptacle for supplying power to an electrical plug, comprising:

at least one outlet for receiving load and neutral prongs of the electrical plug, the outlet having a plug prong contact pair for each of the load and neutral prongs, at least three thermal sensors for sensing temperature at respective locations in the electrical receptacle and for detecting temperature greater than a predetermined threshold, each of the thermal sensors having a bimetal and an associated spring, and a power cutoff mechanism for interrupting power to the electrical plug when at least one of the thermal sensors detects temperature greater than the predetermined threshold, the power cutoff mechanism having a shaft spring, a latch and a shot pin, wherein the shot pin is flush with an exterior of the electrical receptacle when unreleased, and when one of the bimetals reaches a temperature greater than the predetermined threshold, the bimetal releases its associated spring which moves the latch to release the shaft spring that pushes the shot pin to protrude from the exterior of the electrical receptacle.

2. The electrical receptacle of claim 1, having five thermal sensors.

3. The electrical receptacle of claim 1, wherein the power cutoff mechanism includes a pair of contacts that are disconnected when the shot pin prodrudes thereby interrupting the power to the electrical plug.

4. The electrical receptacle of claim 1, further comprising a neutral conductor; a load conductor; a hot conductor; terminals connected to each of the neutral, load and hot conductors; and wherein a thermal sensor is associated with each of the terminals.

5. The electrical receptacle of claim 1 having two outlets, and wherein a thermal sensor is associated with each of the plug prong contact pairs in each of the outlets.

6. The electrical receptacle of claim 1, wherein one end of the latch is U-Shaped.

7. The electrical receptacle of claim 1, wherein one end of the latch is L-shaped.

8. The electrical receptacle of claim 1, wherein the latch has an oval opening through which the shot pin protrudes.

* * * * *